United States Patent [19]

Kushnick

[11] Patent Number: 4,582,117

[45] Date of Patent: Apr. 15, 1986

[54] HEAT TRANSFER DURING CASTING BETWEEN METALLIC ALLOYS AND A RELATIVELY MOVING SUBSTRATE

[75] Inventor: Julian H. Kushnick, Brooklyn, N.Y.

[73] Assignee: Electric Power Research Institute, Palo Alto, Calif.

[21] Appl. No.: 534,577

[22] Filed: Sep. 21, 1983

[51] Int. Cl.[4] ..... B22D 27/08; B22D 11/06

[52] U.S. Cl. ..... 164/463; 164/423; 164/429; 164/479; 164/71.1

[58] Field of Search ..... 164/463, 423, 427, 429, 164/479, 71.1; 165/84

[56] References Cited

U.S. PATENT DOCUMENTS

| | | | |
|---|---|---|---|
| 2,514,797 | 7/1950 | Robinson | 165/84·X |
| 2,820,263 | 1/1958 | Fruengel | 164/511 |
| 2,897,557 | 8/1959 | Ornitz | 164/501 |
| 3,461,942 | 8/1969 | Hoffman et al. | 164/501 |
| 3,512,401 | 5/1970 | Thalmann | 73/637 |
| 3,678,988 | 7/1972 | Tien et al. | 164/501 |
| 4,221,257 | 9/1980 | Narasimhan | 164/463 |

FOREIGN PATENT DOCUMENTS

| | | | |
|---|---|---|---|
| 58-110995 | 7/1983 | Japan | 165/84 |

*Primary Examiner*—Kuang Y. Lin
*Attorney, Agent, or Firm*—King and Schickli

[57] ABSTRACT

A casting assembly has a casting nozzle for dispensing a melt puddle upon a casting surface of a continuously moving chilled substrate. A vibratory support contacts the chilled substrate opposite the casting nozzle and includes an ultrasonic transducer for exciting the substrate. The support applies ultrasonic vibrations through the substrate to the melt puddle prior to the critical period of solidification for enhancing wetting of the substrate and improving heat transfer between the melt puddle and the chilled substrate.

11 Claims, 2 Drawing Figures

HEAT TRANSFER DURING CASTING BETWEEN METALLIC ALLOYS AND A RELATIVELY MOVING SUBSTRATE

TECHNICAL FIELD

The invention relates generally to continuous metal casting and more particularly concerns the enhanced wetting of molten metal deposited onto a chilled substrate for improved heat transfer between the molten metal and the substrate. The invention will be specifically disclosed in connection with a casting assembly for enhancing heat transfer between a chilled substrate and a relatively thin, elongated ribbon of metallic glass alloy.

BACKGROUND OF THE INVENTION

It is known in the prior art that the formation of groups of large crystals in molten metal may be inhibited by subjecting the molten metal to high frequency vibrations. In recognition of this fact, prior attempts have been made to subject molten metal to such vibrations immediately prior to casting. For example, early suggestions included applying high frequency vibrations to crucibles containing molten metal to be cast. For the most part, however, attempts to vibrate crucibles have proved unsuccessful. Most crucibles are formed of ceramic material and do not conduct vibrations very well. Furthermore, a crucible is a relatively massive structure and vibrating such a structure generates significant power losses.

A further suggestion for subjecting molten metal to high frequency vibrations immediately prior to casting is found in U.S. Pat. No. 2,419,373 to Schrumn, wherein a solenoid cone is precisely fitted in the bottom of a cylindrically shaped static mold for applying ultrasonic vibrations. Longitudinal vibratory movements are applied to a core, which vibrations are, in turn, transmitted to molten metal poured into the mold. The molten metal is allowed to cool and solidify while vibrations are applied by the solenoid cone.

The application of ultrasonic vibrations to static casting molds is also disclosed in U.S. Pat. No. 2,897,557 to Ornitz and U.S. Pat. No. 3,678,998 to Tien et al. In Ornitz, a fusible metal member is inserted into a casting mold and subjected to vibrations. The inserted metal member has a composition that is either the same as or compatible with the cast product and is substantially melted and dispersed into the cast product during the solidification process.

In the aforementioned Tien et al patent, a probe is inserted into the upper end of a static mold for a molten metal casting. The probe applies ultrasonic vibrations to the molten metal during the solidification process. In order to prevent capture of the probe by the solidified metal, the probe is positioned away from a chill plate for cooling the metal and is removed from the metal before the solidification front reaches a point to encompass the probe.

A method and apparatus for casting metal dental castings, jewelry and other precision castings is disclosed in U.S. Pat. No. 3,461,942 to Hoffman et al. A mold has a cover with an opening for the insertion of a vibrating probe connected to a transducer. The Hoffman et al reference teaches casting of different metals upon each other in layers while simultaneously subjecting the metals to heating and vibratory movement from the probe. The different metals are cohesively bonded in layers without substantial intermixing.

In U.S. Pat. No. 2,820,263, a special ladle having an ultrasonic generator or transducer in its handle is disclosed. The vibrations applied to the ladle are transmitted to molten metal as it is being transported between a crucible and a mold.

The application of ultrasonic vibrations to a continuous casting is taught in U.S. Pat. No. 3,512,401 to Thalmann. A cooling body is positioned closely above a relatively moving hot metal casting. A cooling agent, preferably water, is introduced into the cooling body for flowing contact with the hot casting. An ultrasonic transducer applies a vibratory movement to the flowing water which, in turn, couples the vibrations to the hot casting.

SUMMARY OF THE INVENTION

Applicant has discovered that wetting of metallic glass alloys on continuously moving substrates may be improved by subjecting a liquid metal melt puddle beneath a casting nozzle to ultrasonic vibrations. Moreover, it has been discovered that the application of ultrasonic vibrations to the melt puddle on a quenching surface increases the contact area between the alloy and the substrate for improved heat transfer.

It is thus an object of the invention to provide a continuous casting apparatus for enhancing wetting of a metallic alloy on a casting substrate.

It is a further object of the invention to provide a continuous casting apparatus for providing improved heat transfer between a chilled substrate and a molten metal product deposited thereon.

It is another object of the invention to provide a continuous casting apparatus for applying ultrasonic vibrations to a melt puddle during the critical period prior to solidification.

It is yet another object of the invention to provide a casting apparatus for inexpensively exciting a continuously moving molten metal product on a chilled substrate with vibratory movement.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for improving heat transfer between cast metallic glass alloys and a casting surface. The apparatus includes a reservoir for molten metal. A casting nozzle in fluid communication with the reservoir is provided for dispensing molten metal onto a continuously moving chilled substrate. The substrate includes a casting surface for receiving a puddle of molten metal from the nozzle and transporting the metal from the puddle to form an elongated filament as the metal is quenched.

In accordance with the broad aspects of the invention, means are also provided for applying ultrasonic vibrations to the chilled substrate to subject the melt puddle deposited thereon to ultrasonic vibration prior to the critical period of solidification whereby wetting of the substrate by the molten metal is enhanced for improved heat transfer between the molten metal and the substrate.

The ultrasonic vibrations are preferably applied to the substrate beneath the puddle and opposite the casting nozzle. Preferably, the applied vibrations are at a frequency between 20 and 100 kilocycles.

According to a more specific aspect of the invention, a vibratory support is provided for supporting the substrate subjacent to the puddle and opposite the nozzle. An ultrasonic transducer is associated with the vibratory support for applying vibratory movement to the substrate and the melt puddle deposited thereon.

In accordance to a further aspect of the invention, a method for casting a continuous filament is provided for improving heat transfer between the filament and a relatively moving chilled substrate. The method includes the steps of effectuating relative movement between a casting nozzle and a chilled substrate positioned beneath the nozzle and continuously dispensing molten metal through the nozzle to form a melt puddle on the substrate. Ultrasonic vibrations are applied to the substrate directly beneath the melt puddle prior to solidification.

The ultrasonic vibrations are preferably applied to the melt puddle through a vibratory support beneath the substrate. Most preferably, the applied vibrations are between 20 and 100 kilocycles.

Still other objects of the present invention will become readily apparent to those skilled in this art from the foregoing description wherein there is shown and described a preferred embodiment of this invention, simply by way of illustration of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawings incorporated in and forming a part of the specification, illustrate several aspects of the present invention, and together with the description serve to explain the principles of the invention. In the drawings.

Figure 1:
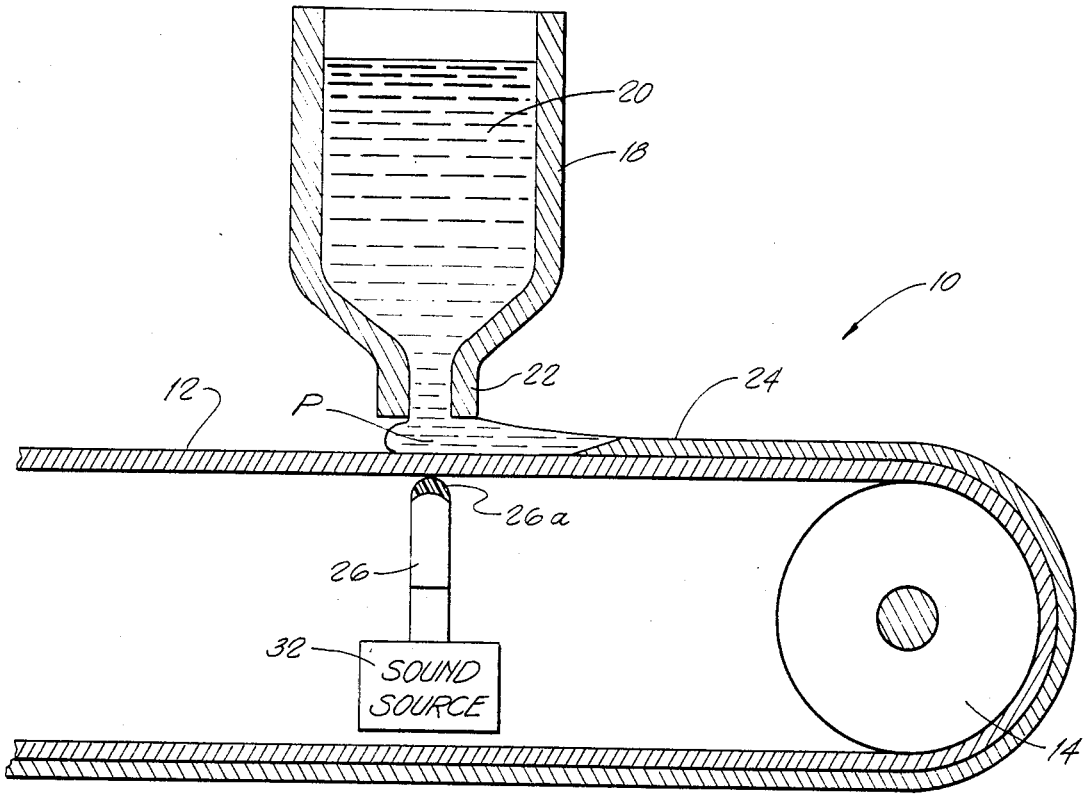
FIG. 1 is a schematic side elevational depiction of a casting assembly for applying ultrasonic vibrations to a substrate opposite a dispensing means.

Reference will now be made in detail to the present preferred embodiment of the invention, an example of which is illustrated in the accompanying drawings.

BEST MODE OF CARRYING OUT THE INVENTION

Reference is now made to the drawings schematically depicting an improved casting apparatus 10 for improved wetting of a metallic glass alloy cast onto a continuously moving chilled substrate 12. The illustrated chilled substrate 12 is in the form of a continuously moving endless belt extending between a pair of end rollers 14 (only one of which is shown in the drawings). The chilled substrate 12 has an outer casting surface for receiving and quenching a cast molten metal product on the upper run of the belt.

A crucible 18 is positioned above the upper run of the substrate 12 to provide a reservoir for a quantity of molten amorphous metal 20. A casting nozzle 22 is secured to the lower portion of the crucible 20 in fluid communication with the reservoir for receiving molten metal 20 from the crucible 18 and dispensing the molten metal onto the chilled substrate 12. Flow of molten metal 20 from the crucible 18 to the casting nozzle 22 may be enhanced by a pressure system (not shown) in the crucible 18, the pressure system being regulated so as to dispense molten metal at the desired rate, as is conventional in the art. The pressure system may be of any conventional design, such as gas overpressure, head pressure of the molten metal or the like.

The substrate 12 may also be cooled by any of several well known methods, such as a chilled water cooling box for continuously directing a spray of chilled water against the return run of the belt 12. Specific flow rates for dispensing molten metal through the nozzle 22, travel speeds for the chilled substrate 12 and chill rates applied to the substrate 12 are well known in the art and may be selected to produce the particular desired casting results in accordance with conventional practice.

Molten metal 20 received by the nozzle 22 is dispensed through a discharge orifice (see FIG. 1) in the nozzle 22 to form the desired cast product. In the preferred embodiment, the discharge orifice in the nozzle is elongated in a direction transverse to substrate 12 movement, and the cast product takes the form of a relatively thin elongated ribbon 24 of amorphous metal. The molten metal 20 is deposited onto the casting surface of the relatively moving chilled substrate 12 immediately beneath the nozzle 22 as a melt puddle P and quickly begins to solidify.

As illustrated, the ribbon 24 is dispensed on the upper run of the substrate 12 adjacent the end roller 14. The cast ribbon 24 then clings to the chilled substrate 12 as the substrate 12 travels about the end roller 14 to reorient the ribbon 24 on the lower run of the substrate 12. Retention means (not shown) such as a counter-rotating "hugger" belt or magnets may be used to assist in securing the ribbon 24 to the lower run of the substrate 12 against the pull of gravity.

Figure 2:
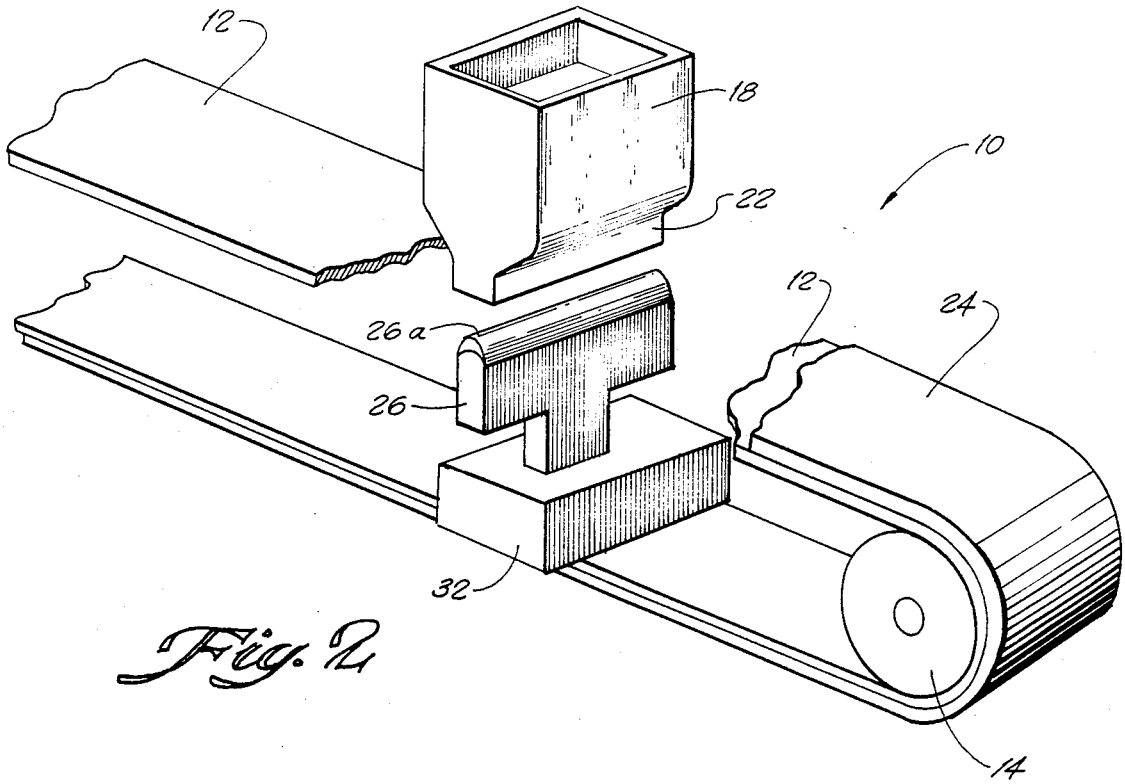
FIG. 2 is a perspective view of the casting assembly of FIG. 1 depicting a vibratory support in contact with the interior substrate surface opposite the dispensing means.

In accordance to the broad aspects of the invention, a vibratory support 26 contacts the interior surface of the chilled substrate 12 directly beneath the melt puddle P, opposite the dispensing nozzle 22. The vibratory support 26 extends from a magnetic transducer 32 for exciting the support 26 with vibratory movement. This vibratory movement is, in turn, transmitted to the melt puddle P through the substrate 12. As indicated from the depiction of FIG. 2, the vibratory support 26 preferably is in the form of a blade with a contact edge extending beneath the entire width of the melt puddle P to enhance distribution of the applied vibratory energy. As illustrated, the upper edge of the vibratory support 26 (contacting the interior substrate surface) is arcuate in the direction of substrate movement to minimize the contact area with the substrate 12 and correspondingly reduce frictional drag on the substrate 12. This arcuate contacting surface is preferably covered with a low friction, wear resistant coating 26*a*, such as graphite impregnated plastic or metal. Alternatively, a fluorocarbon polymer such as polytetrafluoroethylene (sold under the trademark Teflon), may be used to cover the arcuate contacting surface.

The magnetic transducer 32 preferably applies a vibratory movement at a frequency between 20 and 100 kilocycles to the support 26, which vibratory movement is applied to the substrate 12. The positioning of the vibratory support 26 opposite the casting nozzle 22 subjacent the melt puddle P insures that the metal will be in a molten state when subjected to the vibratory movements.

Applying ultrasonic vibrations to the melt puddle P aids in the dispersal of entrapped air. Releasing the trapped air increases the molten metal/substrate contact area and enhances wetting of the substrate 12 by the molten metal. As a result, improved heat transfer between the chilled substrate and the molten metal ribbon 24 is achieved.

The application of ultrasonic vibrations to the molten metal through a sonic transducer disposed beneath the substrate 12 opposite the casting nozzle 22 insures that the melt puddle P will be subjected to vibrations during the critical periods prior to solidification. Furthermore, the vibrations applied in this manner may be applied without undue power losses and without the considerable expense of a water media or the like to couple the ultrasound into the moving substrate. Moreover, the use of obtrusive probes contacting the cast metal is eliminated.

In summary, numerous benefits have been described which result from employing the concepts of the invention. The invention enhances the heat transfer between the casting substrate and the molten metal deposited thereon for improved quality of a continuously cast product. The positioning of a sonic transducer in a subjacent vibratory support for the substrate opposite the casting nozzle insures that vibratory movement is applied to the melt puddle in the critical period prior to solidification. As a result, entrapped air in the molten metal is released and improved surface contact with the substrate results. Applying the vibrations to the molten metal product through the substrate eliminates the necessity of direct probe contact and is relatively inexpensive.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. An apparatus for casting a continuous metal filament, comprising:

(a) a reservoir for molten metal;

(b) a casting nozzle in fluid communication with the reservoir for dispensing molten metal therefrom;

(c) a chilled substrate, including a casting surface for receiving a puddle of molten metal dispensed from the nozzle, said substrate being movable relative to said nozzle to transport and solidify molten metal from the puddle to form an elongated filament; and (d) means for applying ultrasonic vibrations to said chilled substrate beneath the puddle to subject the puddle to ultrasonic vibration prior to solidification whereby wetting of the substrate by the molten metal is enhanced for improved heat transfer between the molten metal and the substrate.

2. An apparatus as recited in claim 1 wherein the means for applying ultrasonic vibrations imparts vibrations at a frequency between 20 and 100 kilocycles.

3. An apparatus as recited in claim 2 wherein the means for applying ultrasonic vibrations includes a vibratory support beneath said substrate opposite the nozzle and an ultrasonic transducer associated therewith for exciting the substrate through the vibratory support.

4. An apparatus as recited in claim 3 wherein the vibratory support is in contact with the substrate beneath substantially the entire width of the casting nozzle.

5. An apparatus as recited in claim 3 wherein the vibratory support includes an arcuate surface in contact with the substrate substantially beneath the casting nozzle.

6. An apparatus as recited in claim 5 wherein the arcuate contact surface includes a low friction, wear resistant coating.

7. An apparatus as recited in claim 6 wherein the low friction, wear resistant coating is graphite impregnated plastic.

8. An apparatus as recited in claim 6 wherein the low friction, wear resistant coating is a fluorocarbon polymer.

9. A method of casting a continuous filament for improved heat transfer between the filament and a relatively moving chilled substrate, comprising:

(a) effectuating relative movement between a casting nozzle and a chilled substrate positioned beneath the nozzle;

(b) continuously dispensing molten metal through the nozzle to form a melt puddle on the relatively moving substrate; and (c) applying ultrasonic vibrations to the substrate directly beneath the melt puddle to subject the melt puddle to ultrasonic vibration prior to metal solidification.

10. A method as recited in claim 9 wherein the step of applying ultrasonic vibrations to the substrate includes supporting the substrate beneath the melt puddle with a vibratory support and applying ultrasonic vibrations to the substrate through the vibratory support.

11. A method as recited in claim 10 wherein the step of applying ultrasonic vibrations to the substrate further includes vibrating the substrate at a frequency between 20 and 100 kilocycles.

* * * * *